US005441287A

United States Patent [19]

Tang

[11] Patent Number: 5,441,287

[45] Date of Patent: Aug. 15, 1995

[54] SIMPLIFIED STEERABLE ROLLER SKATE

[76] Inventor: Kuo-Tai Tang, c/o Hung Hsing Patent Service Center, P.O. Box 55-1670, Taipei, Taiwan

[21] Appl. No.: 317,874

[22] Filed: Oct. 4, 1994

[51] Int. Cl.[6] ..... A63C 17/02

[52] U.S. Cl. ..... 280/11.28; 280/11.27

[58] Field of Search ..... 280/11.19, 11.27, 11.28

[56] References Cited

U.S. PATENT DOCUMENTS

| | | | |
|---|---|---|---|
| 2,509,324 | 5/1950 | Van Horn | 280/11.28 |
| 3,024,033 | 3/1962 | Skaggs | 280/11.28 |
| 4,659,095 | 4/1987 | Halvorsen | 280/11.27 |
| 5,029,882 | 7/1991 | Marandel | 280/11.28 |

*Primary Examiner*—Richard M. Cambry

[57] ABSTRACT

A steerable roller skate includes: a sole member of a skate boot or strap of roller skate having a pair of rear wheels rotatably transversely secured to a rear bottom portion of the sole member, a steering base steerably secured on a front bottom portion of the sole member, a pair of front wheels rotatably transversely secured on the steering base, and a stabilizing disk generally circular shaped and mounted on an intermediate bottom portion of the sole member for frictionally contacting an arcuate edge portion formed on a rear base portion of the steering base for stabilizing the steering base when biasing the steering base rightwardly, leftwardly, or when orienting straight forwardly for enhancing skate safety.

3 Claims, 3 Drawing Sheets

SIMPLIFIED STEERABLE ROLLER SKATE

BACKGROUND OF THE INVENTION

U.S. Pat. No. 5,183,277 granted to the same inventor of this application disclosed a roller skate including: a sole member having a steering base steerably rotatably mounted under the sole member about an axis of a bolt vertically secured to the sole member having a pair of front wheels rotatably secured to an axle transversely fixed to the steering base, a pair of rear wheels rotatably mounted on a rear bracket secured to the sole member, and two tensioning springs securing and tensioning the steering base to the sole member for preventing a suddenly large turning angle of the skate and preventing falling off of the player from the skate when changing the direction of skate operation, whereby upon a rightward or a leftward twisting of the sole member actuated by a player's foot, the sole and the player carried by the sole will be oriented either rightwardly or leftwardly about the bolt axis so as for ensuring a safer variation of skating orientations for enhancing the player's interest.

However, the two tensioning springs (41, 42) for tensioning the steering base to the sole member may have the following drawbacks:

1. The tensioning springs may be tangled or tied with other objects to cause danger during a skate operation.
2. The tensioning springs may occupy a volume to influence a decorative feature or appearance of the complete roller skate.
3. For fastening or fixing the two springs on the roller skate, several fixing elements or parts should be provided to increase the production complexity and assembly cost as well as maintenance problems.

The present inventor has found the drawbacks of the U.S. Pat. No. 5,183,277 and invented the present simplified steerable roller skate.

SUMMARY OF THE INVENTION

The object of the present invention is to provide a steerable roller skate including: a sole member of a skate boot or strap of roller skate having a pair of rear wheels rotatably transversely secured to a rear,bottom portion of the sole member, a steering base steerably secured on a front bottom portion of the sole member, a pair of front wheels rotatably transversely secured on the steering base, and a stabilizing disk generally circular shaped and mounted on an intermediate bottom portion of the sole member for frictionally contacting an arcuate edge portion formed on a rear base portion of the steering base for stabilizing the steering base when biasing the steering base rightwardly, leftwardly, or when orienting straight forwardly for providing a simple structure for enhancing skate safety.

DETAILED DESCRIPTION

Figure 1:
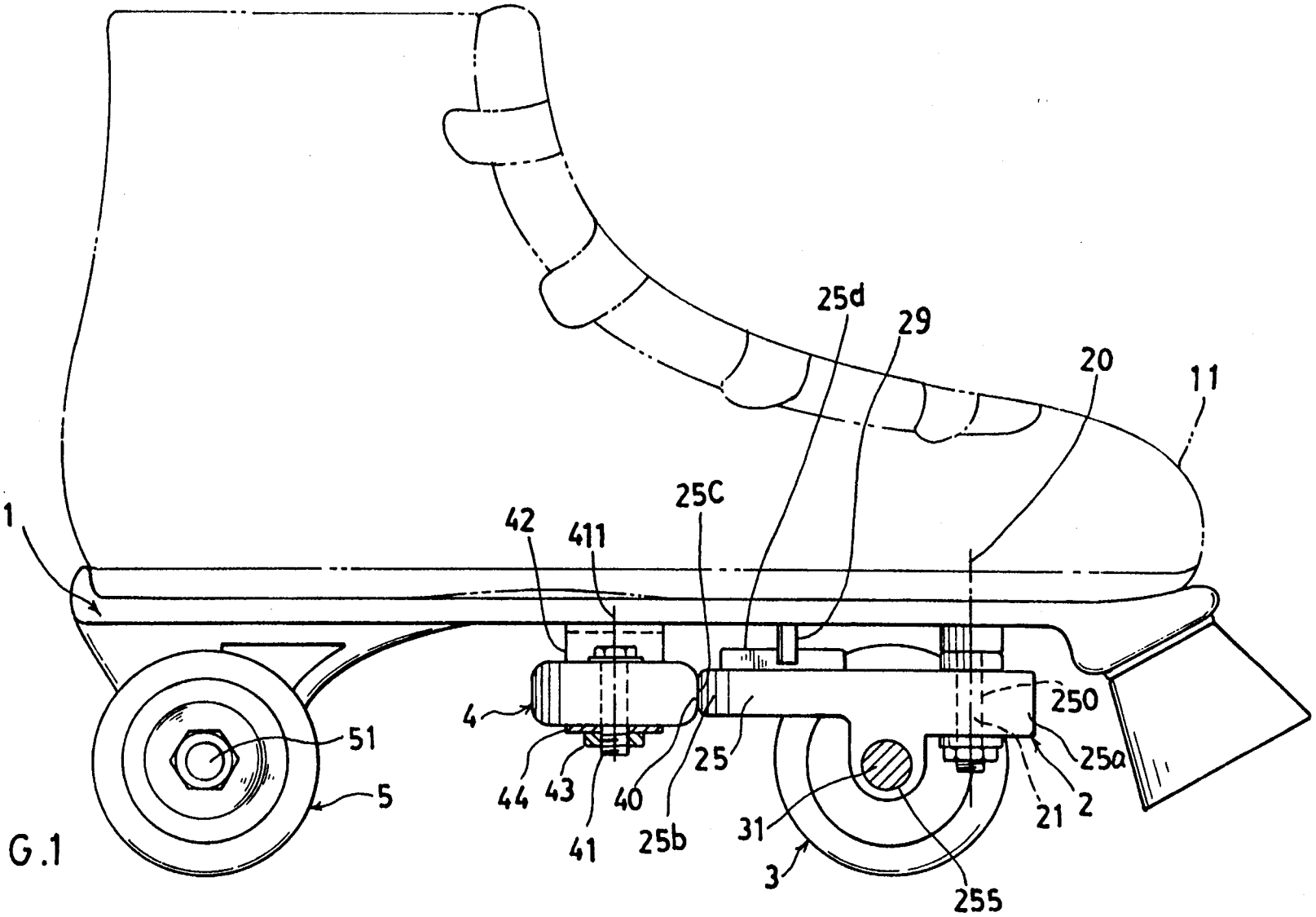
FIG. 1 is a front elevational illustration of the present invention.
Figure 2:
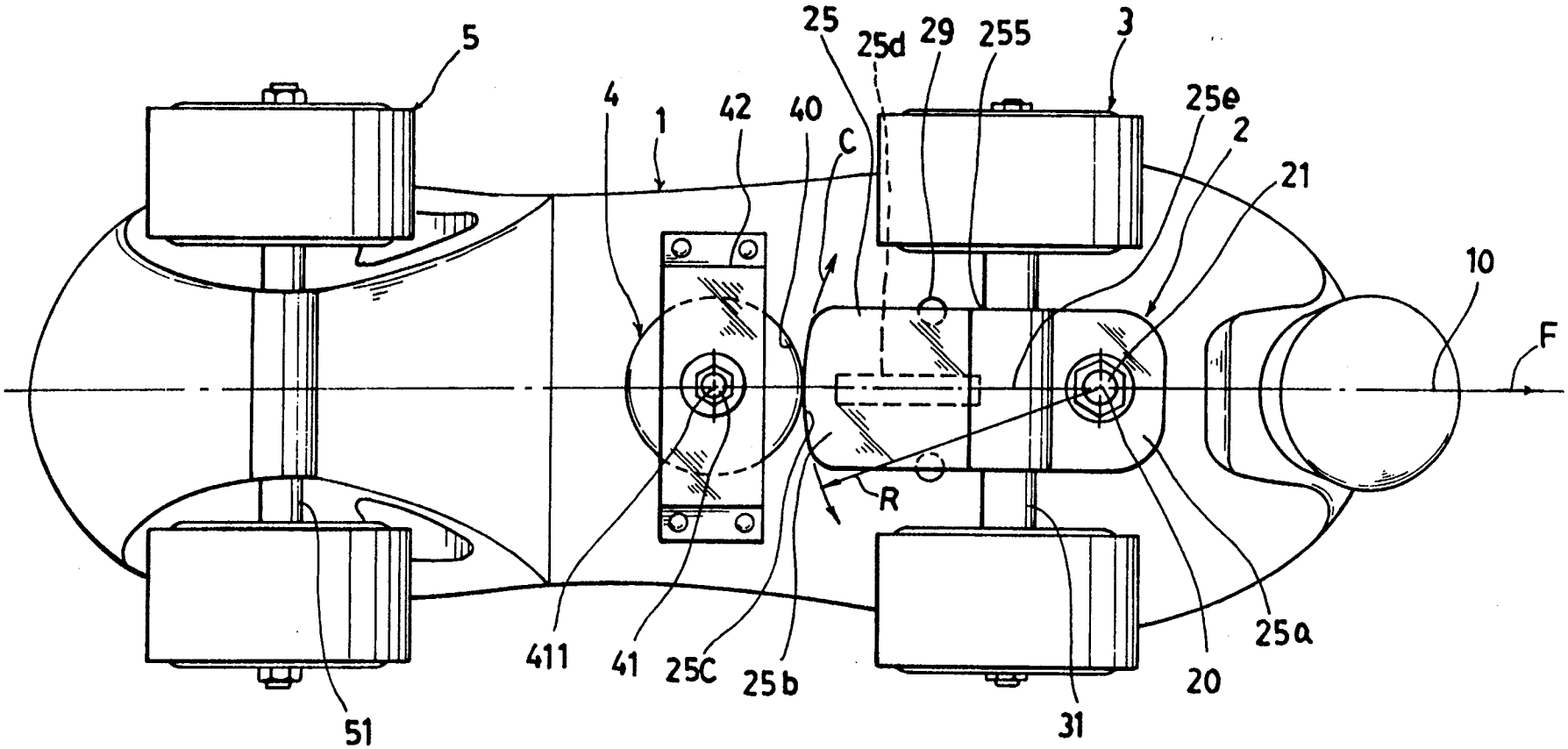
FIG. 2 is a bottom view illustration of the present invention for a straight forward skate use.
Figure 3:
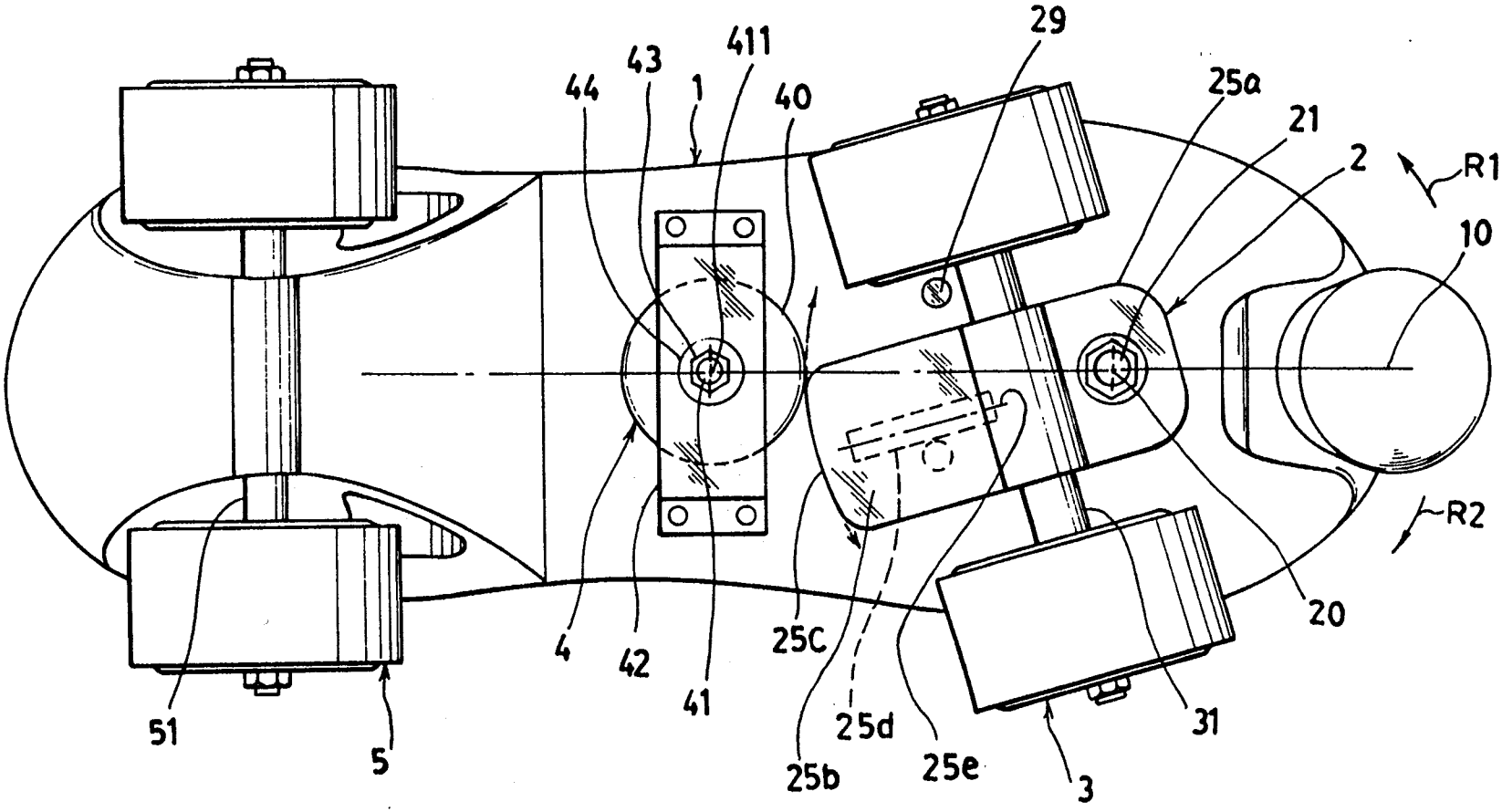
FIG. 3 is a bottom view illustration of the present invention when biased sidewardly for steering the skate orientation.

As shown in FIGS. 1–3, the present invention comprises: a sole member 1 of a skate boot or fastening strap 11 of a roller skate defining a longitudinal axis 10 at a longitudinal center of the sole member 1, a steering means 2 steerably secured to a front bottom portion of the sole member 1, a pair of front wheels 3 rotatably transversely secured on the steering means 2, a stabilizing disk 4 mounted on an intermediate bottom portion of the sole member 1 for stabilizing the steering means 2, and a pair of rear wheels 5 rotatably transversely secured to a rear bottom portion of the sole member 1. The pair of rear wheels 5 are rotatably secured on a rear axle 51, generally perpendicular to the longitudinal axis 10 of the sole member 1.

The steering means 2 includes: a steering base 25 having a front base portion **25*a* drilled with a vertical bolt hole 250 for rotatably engaging a front bolt 21 vertically secured in a front bottom portion of the sole member 1 about a front vertical axis 20, an axle hole 255 horizontally transversely formed through a middle portion of the steering base 25 for rotatably engaging a front axle 31 for rotatably securing the pair of front wheels 3 on the steering base 25, and an arcuate edge portion 25*c* arcuately formed on a rear base portion 25*b* of the steering base 25 for frictionally engaging the stabilizing disk 4 and defining a curvature C about a center at the front vertical axis 20** with a radius R.

The stabilizing disk 4 is generally circular shaped having a perimeter 40 in tangential contact with the arcuate edge portion **25*c* of the steering base 25, and a center of the disk 4 vertically aligned with a disk-bolt axis 411 of a disk bolt 41 vertically secured on a disk bracket 42 secured to an intermediate bottom portion of the sole member 1 for mounting the stabilizing disk 4 on the disk bracket 42 by nut 43 and washer 44**.

The stabilizing disk 4 is made of elastomer materials such as polyurethane (PU) or rubber to have frictional contact with the arcuate edge portion **25*c* formed on a rear base portion 25*b* of the steering base 25**.

The steering base 25 further includes a limiting projection **25*d* protruding upwardly from a central portion of the steering base 25 to be retarded by a pair of stoppers 29 respectively disposed on two opposite side portions on a front bottom portion of the sole member 1** to prevent falling off of a skate player when rightwardly (R1) or leftwardly (R2) steering a roller skate of the present invention.

When using the present invention in a skate operation for a rightward or leftward orientation of the roller skate (FIG. 3) by operating the steering means 2 rightwardly or leftwardly, the rear arcuate edge portion **25*c* of the steering base 25 will be in frictional contact with the perimeter 40 of the stabilizing disk 4 to dampen a rapid biasing movement of the steering base 25** when suddenly changing the rightward or leftward skate directions to thereby prevent falling off of the player of the roller skate for safety purpose.

The "complex" two tensioning springs (41, 42) as provided on the prior U.S. Pat. No. 5,183,277 will now be eliminated for reducing the production cost and maintenance problems.

By straightly orienting the steering base 25 of the steering means 2 by aligning a longitudinal axis **25*e* at a longitudinal center of the steering base 25 with the longitudinal axis 10 of the sole member 1 as direction F shown in FIG. 2, the front axle 31 will be projectively perpendicular to the longitudinal axis 10 of the sole member 1 and the roller skate of this invention will be operated straight forwardly. The frictional contacting between the rear arcuate edge portion 25*c* of the steering base 25 and the perimeter 40 of the stabilizing disk 4** will help stabilize such a straight-forward orientation of the skate.

The present invention may be modified without departing from the spirit and scope of this invention.

I claim:

1. A steerable roller skate comprising:

a sole member (1) having a pair of rear wheels (5) rotatably transversely secured to a rear bottom portion of the sole member (1), a steering means (2) having a steering base (25) steerably secured on a front bottom portion of the sole member (1), a pair of front wheels (3) rotatably transversely secured on the steering means (2), and a stabilizing disk (4) mounted on an intermediate bottom portion of the sole member (1) for frictionally contacting the steering base (25) for stabilizing a biasing movement of the steering base (25) when changing a skate orientation for safety purpose;

said steering means (2) including: the steering base (25) having a front base portion (25*a*) drilled with a vertical bolt hole (250) for rotatably engaging a front bolt (21) vertically secured in a front bottom portion of the sole member (1) about a front vertical axis (20), an axle hole (255) horizontally transversely formed through a middle portion of the steering base (25) for rotatably engaging a front axle (31) for rotatably securing the pair of front wheels (3) on the steering base (25), and an arcuate edge portion (25*c*) arcuately formed on a rear base portion (25*b*) of the steering base (25) for frictionally engaging the stabilizing disk (4) and defining a curvature (C) about a center at the front vertical axis (20) with a radius (R); and said stabilizing disk (4) generally circular shaded and having a perimeter (40) in tangential contact with the arcuate edge portion (25*c*) of the steering base (25), and a center of the disk (4) vertically aligned with a disk-bolt axis (411) of a disk bolt (41) vertically secured on a disk bracket (42) secured to an intermediate bottom portion of the sole member (1) for mounting the stabilizing disk (4) on the disk bracket (42).

2. A steerable roller skate according to claim 1, wherein said stabilizing disk (4) is made of elastomer materials to have frictional contact with the arcuate edge portion (25*c*) formed on said rear base portion (25*b*) of the steering base (25).

3. A steerable roller skate according to claim 1, wherein said steering base (25) includes a limiting projection. (25*d*) protruding upwardly from a central portion of the steering base (25) to be retarded by a pair of stoppers (29) respectively disposed on two opposite side portions on a front bottom portion of the sole member (1) to prevent falling off of a skate player in a rightward or leftward steering.

* * * * *